US008679860B1

(12) United States Patent
Hearne

(10) Patent No.: US 8,679,860 B1
(45) Date of Patent: Mar. 25, 2014

(54) LATERAL ELECTRODEPOSITION OF COMPOSITIONALLY MODULATED METAL LAYERS

(75) Inventor: Sean J. Hearne, Albuquerque, NM (US)

(73) Assignee: Sandia Corporation, Albuquerque, NM (US)

( * ) Notice: Subject to any disclaimer, the term of this patent is extended or adjusted under 35 U.S.C. 154(b) by 357 days.

(21) Appl. No.: 12/855,080

(22) Filed: Aug. 12, 2010

Related U.S. Application Data

(62) Division of application No. 11/499,964, filed on Aug. 7, 2006.

(51) Int. Cl.
*H01L 21/00* (2006.01)

(52) U.S. Cl.
USPC ..... 438/3

(58) Field of Classification Search
None
See application file for complete search history.

(56) References Cited

U.S. PATENT DOCUMENTS

| | | | | |
|---|---|---|---|---|
| 5,374,338 | A * | 12/1994 | Boyko et al. | 205/666 |
| 6,014,296 | A * | 1/2000 | Ichihara et al. | 360/135 |
| 6,478,931 | B1 * | 11/2002 | Wadley et al. | 204/192.12 |
| 6,967,864 | B2 * | 11/2005 | Kajiyama | 365/158 |
| 7,876,529 | B1 * | 1/2011 | Benakli et al. | 360/135 |
| 2003/0143482 | A1 * | 7/2003 | Nozaki et al. | 430/270.1 |
| 2004/0023057 | A1 * | 2/2004 | Kamijima | 428/592 |
| 2005/0233178 | A1 * | 10/2005 | Sugimoto et al. | 428/839 |
| 2006/0033133 | A1 * | 2/2006 | Liu et al. | 257/295 |

* cited by examiner

*Primary Examiner* — Benjamin Sandvik
(74) *Attorney, Agent, or Firm* — Carol I. Ashby

(57) ABSTRACT

A method for making a laterally modulated metallic structure that is compositionally modulated in the lateral direction with respect to a substrate.

11 Claims, 2 Drawing Sheets

Fig. 2a
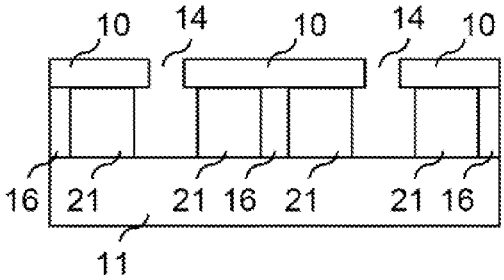
Fig. 2b
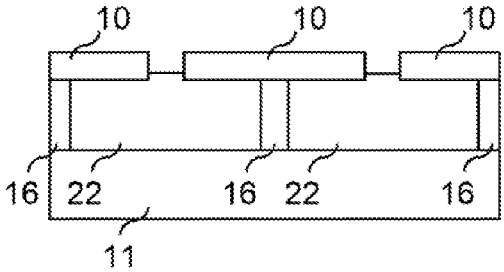
Fig. 2c
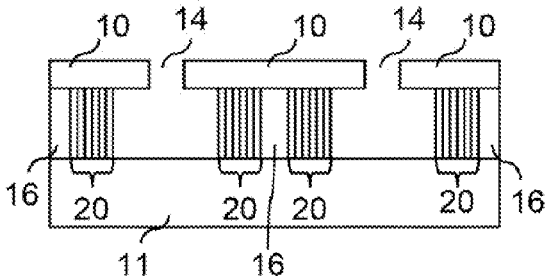
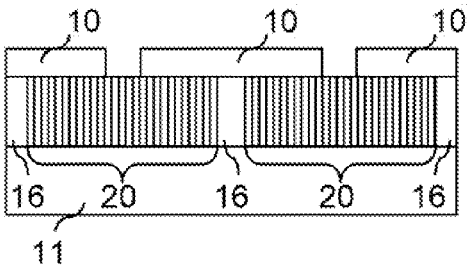
Fig. 2d
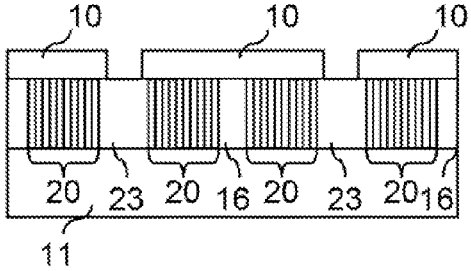
Fig. 2e

LATERAL ELECTRODEPOSITION OF COMPOSITIONALLY MODULATED METAL LAYERS

This application is a divisional application of the prior-filed copending U.S. nonprovisional patent application Ser. No. 11/499,964, filed on Aug. 7, 2006, and claims priority benefit therefrom. This prior-filed copending application is hereby incorporated by reference.

The United States Government has rights in this invention pursuant to Department of Energy Contract No. DE-AC04-94AL85000 with Sandia Corporation.

BACKGROUND OF THE INVENTION

This invention relates to a compositionally modulated metal structure. Compositionally modulated multilayers consist of layers of different metals or alloys. The most common methods for preparing such multilayers are physical deposition by sputtering or by molecular beam epitaxy. Such methods are not suited to the production of layers that are laterally modulated, that is, that are modulated in a direction other than perpendicular to the substrate surface with layer interfaces being roughly parallel to the substrate surface.

Electrodeposition of Co/Cu compositionally modulated multilayers with different sublayer thickness can be produced from a single bath as a function of different pulse potential and deposition charges. Multilayered Co/Cu deposits exhibit giant magnetoresistance (GMR) when the thickness of the bilayers is approximately a few nanometers (E. Gomez, A. Labarta, A. Llorente, and E. Valles, "Characterisation of cobalt/copper multilayers obtained by electrodeposition," Surface and Coatings Technology vol 153 (2002) pp. 261-266). Galvanostatic electrodeposition has been used to produce NiCu/Cu multilayers by pulse plating from a sulfate/citrate electrolyte. GMR contributions were observed for most NiCu/Cu multilayers (E. Toth-Kadar, L. Peter, T. Becsei, J. Toth, L. Pogany, T. Tamoczi, P. Kamasa, I. Bakonyi, G. Lang, A. Cziraki, and W. Schwarzacher, "Preparation and Magnetoresistance Characteristics of Electrodeposited Ni—Cu Alloys and Ni—Cu/Cu Multilayers," J. Electrochem Soc. vol. 149 (2000) pp. 3311-3318).

The preceding work produced multilayers with composition modulated in a vertical direction with respect to a substrate surface. For many applications, it may be advantageous to form a structure with lateral composition modulation. An example of such an application is a magnetoresistive sensor. A method for forming a magnetoresistive sensor has been patented that results in the spontaneous formation by self-assembly of a giant magnetoresistance multilayer structure of alternating stripes of ferromagnetic and nonferromagnetic metal that are stacked laterally on a special template layer. The template layer is a crystalline structure that has a two-fold uniaxial surface, i.e., one that is structurally invariant for rotation by 180 degrees (and only 180 degrees) about an axis (the symmetry axis) perpendicular to the surface plane. Alternating stripes of ferromagnetic metal (such as Co or Fe) and nonferromagnetic metal (such as Ag) become spontaneously arranged laterally on a (110) surface plane of body-centered-cubic Mo during co-deposition (D. E. Chambliss et al., U.S. Pat. No. 5,858,455).

BRIEF DESCRIPTION OF THE DRAWINGS

The accompanying drawings, which are incorporated in and form part of the specification, illustrate some embodiments of the present invention and, together with the description, serve to explain the principles of the invention.

FIG. 2 illustrates some embodiments of metal structures that are compositionally modulated in the lateral direction with respect to a substrate.

DETAILED DESCRIPTION OF THE INVENTION

Figure 1:
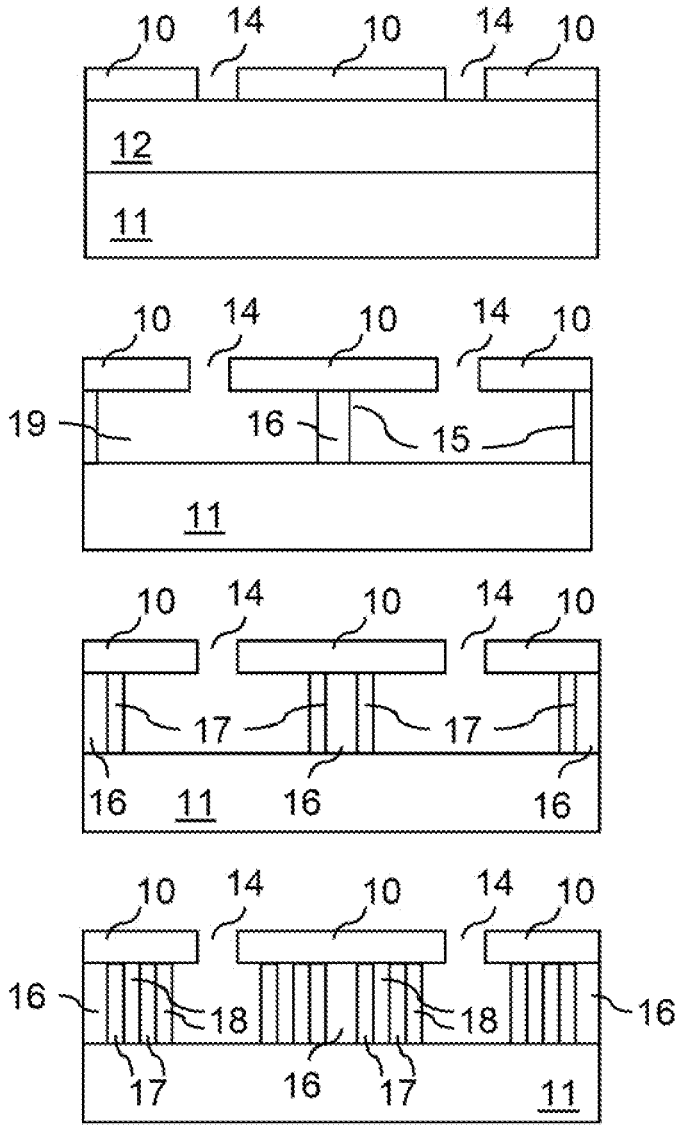
FIG. 1 illustrates an embodiment of the process of forming metal structures that are compositionally modulated in the lateral direction with respect to a substrate.

This invention comprises a compositionally modulated metal layer structure that is grown laterally using electrochemical deposition techniques. The compositionally modulated metal structure need not be modulated vertically, that is, it need not be modulated in the direction normal to the plane of the substrate surface. Rather, it is modulated laterally and the layers are aligned with the surface of the metal sidewall upon which they were electrodeposited. When the sidewall is approximately vertically oriented with respect to a substrate, the compositionally modulated layers can also be approximately vertically oriented with respect to the substrate. Unless defined differently for a specific embodiment, a compositionally modulated metal layer structure is one that exhibits a change in elemental composition as a function of position in the metal structure. Compositional modulation in some embodiments refers to modulation of the crystallographic structural composition of the metal structure. The term metal can refer to an elementally pure metal or to a metal alloy comprising two or more chemical elements. Laterally modulated structures in embodiments of this invention can comprise a first metal layer and a second metal layer that has been grown laterally from one or more sidewalls of the first layer. The first metal layer can be a single element, a constant-composition alloy, an alloy with changing composition as a function of position with respect to the substrate, periodically modulated multilayers of differing combinations of elements, the periodic modulation being abrupt or gradual in nature and the periodic modulation being with respect to the substrate. The second metal layer can be a single element, a constant-composition alloy, an alloy with changing composition as a function of position with respect to the metal layer sidewall, or periodically modulated multilayers of differing combinations of elements, the periodic modulation being abrupt or gradual in nature and with respect to the sidewall.

The formation of the laterally modulated structure involves a patterned mask 10 on a first metal layer 12 that is on a substantially nonconducting substrate 11, such as, for example, an insulator or a wide-band-gap semiconductor. FIG. 1 illustrates the formation process. The mask 10 is generally selected to be resistant to the etching and electroplating solutions used in fabrication of the structure. One or more openings in the mask 14 expose the first metal layer 12 to an etching solution. The size and location of the mask openings are determined by the particular application of the completed metal structure. The metal layer is etched by the etching solution to expose the substantially nonconducting substrate 11. The metal is also undercut beneath the mask during the etching process. When the solution employed produces isotropic etching, the undercut distance is approximately the same as the etched depth until the etching process exposes the substrate. Depending on the etching solution and the composition of the substrate, further etching into the substrate may or may not occur. The lateral undercut distance into the metal can be increased by continuing to etch until the desired lateral undercut distance is achieved.

When the desired undercut distance has been achieved, the etching is halted. A cavity 19 has been produced where material has been etched away. The structure at this point in the process consists of the mask 10 supported by unetched metal 16 of the first metal layer. The surface of the unetched metal 16 is termed a sidewall 15. To laterally electrodeposit the compositionally modulated metal layer on the metal sidewall, a variety of applied-potential protocols (plating protocols) can be used. FIG. 1 illustrates the deposition of multilayers with adjacent layers 17 and 18 alternating between two different compositions. Layer 17 is deposited at a given potential to produce a metal with a certain composition. After deposition of the desired thickness of that composition, the potential is changed to deposit a layer 18 of a different composition. After deposition at this second potential for the length of time that produces the desired thickness of the second composition, the potential is changed back to that which deposits the composition of layer 17, producing a multilayer with alternating layers of the two compositions. In some embodiments, a single plating solution may be used. In other embodiments, two or more plating solutions (baths) may be used with the sample being moved back and forth between the two or more solutions to plate the sequential layers of the various desired compositions.

FIG. 2 illustrates some additional embodiments. In various embodiments, a fixed potential or a time-varying potential may be used. Using a fixed potential, a continuous layer 21 with constant composition is grown laterally from the unetched metal 16 (FIG. 2*a*). If a time-varying potential is monotonically increased or decreased in time during the deposition, the continuous layer 21 will comprise a graded alloy composition with the grading being dependent on the rate of change of the applied potential during lateral deposition. The thickness of the laterally deposited layer can be controlled using the deposition current and time to produce structures that have laterally grown layers 21 separated from each other, as in FIG. 2*a*, or that have a continuous metal layer 22 between the unetched metal regions 16, as in FIG. 2*b*.

In some embodiments, the time-varying potential can be periodic, with changes being gradual or abrupt, as in some pulsed plating protocols. In some embodiments, a pulse-plating protocol can be employed to obtain an abruptly periodically modulated composition such as a metal superlattice 20. The electroplating solution is selected so that variation of the applied potential will change the composition of metal that is deposited during the times of differing potential during the plating process. The metal layer composition is determined by the applied potential and the composition of the plating solution. The thickness of each layer of metal in the periodically modulated metal layer 20 is determined by the current density at the applied potential and the time spent at that potential before changing to another potential in the plating protocol. In some embodiments, the periodically modulated metal layers 20 can be grown from the unetched metal 16 to leave a space between two layers 20 that are growing toward each other, as in FIG. 2*c*. In other embodiments, the periodically modulated metal layers 20 can be grown until they coalesce together, as in FIG. 2*d*. In other embodiments, after growth of the desired thickness of the periodically modulated metal layers 20, a different metal 23 can be grown; this can be grown to leave a space, as in FIGS. 2*a* and 2*c*, or to coalescence as in FIG. 2*e*. Numerous embodiments with various combinations of periodically modulated metal layers, graded alloys, and constant-composition metal can be grown with or without coalescence and are within the scope of this invention.

Metals that are amenable to etching and electroplating are suitable for use in embodiments of this invention. The following metals are very suitable: Cu, copper alloys, Ni, Ni alloys, Ag, Ag alloys, Au, Au alloys, Co, and Co alloys. Other metals not on this list that are amenable to etching and/or electroplating may also be used.

In one embodiment of the invention, a laterally deposited NiCu film was grown from a Cu sidewall. In this embodiment, a glass substrate was coated with 150 Å Ti followed by approximately 5000 Å of Cu, both deposited using an electron beam evaporator. The structure was then covered with a photoresist that was patterned as an array of parallel lines prior to etching. Cathodic etching of the Cu film was accomplished using phosphoric acid, ethylene glycol, and de-ionized water (ratio 5:3:2) at a potential of +1.4V with respect to a calomel reference electrode in a three probe configuration. The remaining Cu lines were nominally 10 microns wide and spanned the width of the sample, which was approximately 10 mm. The Ti film was removed by dipping the sample into a 5% HF and H2O solution for 10 sec. This ensured that there was no conductive material between the Cu lines; this avoided the growth of unwanted metal on surface areas other than the sidewalls. In this and some other embodiments, substrates other than glass may be used as long as they are substantially nonconductive under the electroplating conditions employed, thereby avoiding unwanted metal deposition. Examples of suitable substrates include but are not restricted to insulators and wide-band-gap semiconductors. The photoresist was still present for the electroplating step (electrodeposition step). The NiCu film was then electroplated under the photoresist layer using $NiSO_4$ (0.3M), $CuSO_4$ (0.041M), sodium citrate (0.2M), NaCl (2 g/L) in 17.5 MΩ de-ionized water at 50° C. NiCu film was plated at a potential of −1.01 V vs. open circuit for a time of 600 sec. This formed a metal line on the surface of the substrate that was laterally modulated NiCu/Cu/NiCu (lateral growth occurred off both sidewalls of the Cu line). If desired, the photoresist can be removed following completion of the electrodeposition (electroplating) to expose the laterally compositionally modulated metal surface. For some applications, it may be desirable to leave the mask in place or to replace it with another substantially insulating layer that may be patterned to expose portions of the modulated surface while covering other portions. The material employed as the substantially insulating layer (nonconducting layer) can be one of a wide range of organic and inorganic materials, depending on the particular application. Selection of the material and the portions that are exposed or covered will be dictated by the application.

In one embodiment of the invention, a laterally modulated NiCu/Cu superlattice is made. Such a superlattice is also termed a giant magnetoresistance (GMR) structure. In this embodiment, a glass substrate was coated with 150 Å Ti followed by nominally 5000 Å of Cu, both deposited using an electron beam evaporator. The structure was then covered with a photoresist patterned as an array of parallel lines prior to etching. Cathodic etching (electropolishing) of the Cu was accomplished using phosphoric acid, ethylene glycol, and de-ionized water (ration 5:3:2) at a potential of +1.4V with respect to a calomel reference electrode in a three probe configuration. The Cu lines remaining after this etching step were nominally 10 microns wide and spanned the width of the sample, which was approximately 10 mm. The Ti film was removed by dipping the sample into a 5% HF and $H_2O$ solution for 10 sec. This ensured that there was no conductive material between the Cu lines where undesired electrodeposition could occur. The photoresist was still present for the electroplating step.

The NiCu/Cu super-lattice was then electroplated on the metal sidewall under the photoresist layer using $NiSO_4$ (0.3M), $CuSO_4$ (0.041M), sodium citrate (0.2M), NaCl (2 g/L) in 17.5 MΩ de-ionized water at 50° C. NiCu and Cu layers were plated at a potential of −1.01V and −015 vs. open circuit for a time of 2 sec and 4 sec, respectively. In this embodiment, 240 periods of −1.01V followed by −0.15V were applied, which resulted in a final lateral dimension of approximately 2 microns. The photoresist can be removed following completion of the electrodeposition (electroplating).

In some embodiments, the laterally grown metal has a controlled in-plane texture. The laterally grown metal has a fiber microstructure, which has the characteristic of the crystallographic texture being parallel to the growth direction. For example, electrodeposited Ni can be grown with a dominant (111) texture parallel to the growth direction. The fabrication of an in-plane-textured structure was accomplished as follows. A glass substrate was coated with electron-beam-deposited Ti (15 nm thick) and Cu metal (1 micrometer thick). The Ti was used as an adhesion layer to improve adhesion of the Cu metal to the glass. A patterned photoresist mask layer was formed on the Cu film. This formed an insulate mask to facilitate electropolishing (cathodic etching) of the Cu film and to restrict the geometry of the electrodeposited Ni film. The Cu film was electropolished (cathodically etched) using a solution of phosphoric acid, ethylene glycol, and deionized water in a 5:3:2 ratio for 500 seconds at a potential of +1.5V with respect to open circuit. The Ti layer was removed in the exposed regions using an approximately 15 second dip into a 5% solution of HF in deionized water. The sample was then rinsed in DI water for 5 minutes. Nominally 4 micrometers of Ni were electrodeposited under the photoresist mask using a nickel sulfamate and boric acid plating solution (1.3M and 40 g/l and 40° C.) for 500 seconds at −1.6V versus standard hydrogen electrode. X-ray diffraction images show preferential crystallographic alignment of the Ni deposit that grew from the Cu sidewalls. The lateral plating resulted in controlled in-plane texturing.

The dimensions of the laterally electrodeposited structures that can be formed are dependent on a number of conditions during their formation. Among these are the aperture size in the mask and the thickness of the initial metal layer. The compositionally modulated layer will be substantially the same thickness as the initial metal layer, which determines the separation of the masking material from the substrate. Some masking materials, such as organic photoresists, are mechanically deformable, allowing some variation in the thickness of the initial layer and the electrodeposited layer. The thicknesses are defined as being substantially the same when the thickness of the compositionally modulated layer is constrained to the thickness allowed by deformation of the masking material. Access of etching reagents to the metal layer can be a limiting factor. Electrochemical etching can enhance diffusion and the rate of etching of the metal layer under the mask. Plating into cavities having a depth to width ratio of 1000 is known in the art. For a 30-nm aperture in a mask, this would allow deposition into 15 micrometers of undercut on each side of the mask aperture. Deeper undercuts can be employed with larger mask apertures.

In some embodiments, the substrate may be removed after growth of the compositionally modulated metal layers. The additional process steps for the removal of a portion of the substrate will depend on the elemental composition of the metal layers and the composition of the substrate. The term portion can refer to the entire substrate or to part of the substrate, in which case part of the substrate is removed by etching and part of the substrate remains. If the etching process used for etching the substrate can also etch the metal layers, the metal surface may be protected from exposure to the etchant solution. For example, if the substrate is silicon with an insulating layer such as, for example, silicon oxide or silicon nitride on its surface, portions of the substrate may be removed as follows. If a wet etch is to be used, the metal surface can be coated with a material such as, for example, wax, that protects the metal surface from attack by the wet etchant. One example of a suitable wet etchant for the Si is a KOH solution; other Si etchants are well known to those of skill in the art. The substrate can be removed in a patterned fashion if a suitable patterned resist material is on the substrate during the etching process. Following removal of the Si, the insulating oxide or nitride can be removed. An example of one method of removing the insulating layer is etching in a F-based plasma. This removal can be done in the same pattern as the Si removal or in a different pattern. If the metal surface is protected, the protection may optionally be removed after substrate removal.

A wide range of structures can be envisioned as embodiments of this invention. The initial metal layer can have been prepatterned before deposition of the mask used during the lateral electrodeposition. Additional layers of metal or other materials can be deposited with or without patterning after the lateral electrodeposition of the compositionally modulated layers.

The foregoing description of the invention has been presented for purposes of illustration and description and is not intended to be exhaustive or to limit the invention to the precise form disclosed, and obviously many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

What is claimed is:

1. A method for forming a laterally modulated metallic structure comprising:

forming a pattern in a masking material situated on a first metal layer to form an exposed region of the first metal layer;

etching the exposed region of the first metal layer to expose a substantially nonconductive substrate;

etching the first metal layer between the masking material and the substantially nonconductive substrate for a distance to form a cavity comprising a first metal sidewall and an underside of the masking material; and electrochemically depositing a second metal layer on the first metal sidewall, the second metal layer comprising one or more metals, wherein the second metal layer is deposited in a sideways direction from the first metal sidewall.

2. The method of claim 1, wherein at least one of the one or more metals differs from a metal of the first metal layer.

3. The method of claim 1, wherein the step of etching is a cathodic etching step.

4. The method of claim 1, wherein the step of electrochemically depositing uses a time-varying potential.

5. The method of claim 4, wherein the time-varying potential is a pulsed potential.

6. The method of claim 1, wherein the step of electrochemically depositing uses a periodically varying potential.

7. The method of claim 1, wherein the second metal layer comprises alternating layers of ferromagnetic metal and non-ferromagnetic metal.

8. The method of claim 1, further comprising removing the masking material after the step of electrochemically depositing.

9. The method of claim 1, wherein the first metal layer is selected from the group consisting of Cu, a copper alloy, Ni, a Ni alloy, Ag, a Ag alloy, Au, a Au alloy, Co, and a Co alloy.

10. The method of claim 1, wherein the one or more metals of the second metal layer are selected from the group consisting of Cu, a copper alloy, Ni, a Ni alloy, Ag, a Ag alloy, Au, a Au alloy, Co, and a Co alloy.

11. The method of claim 1, further comprising removing a portion of the substantially nonconductive substrate.

* * * * *